US005686935A

United States Patent [19]

Weisbrod

[11] Patent Number: 5,686,935

[45] Date of Patent: Nov. 11, 1997

[54] DATA LINE DRIVERS WITH COLUMN INITIALIZATION TRANSISTOR

[75] Inventor: Sherman Weisbrod, Skillman, N.J.

[73] Assignee: Thomson Consumer Electronics, S.A., Courbevoie, France

[21] Appl. No.: 399,012

[22] Filed: Mar. 6, 1995

[51] Int. Cl.[6] ..... G09G 3/36

[52] U.S. Cl. ..... 345/100; 345/104; 345/204

[58] Field of Search ..... 345/90–93, 100, 345/98, 104, 204

[56] References Cited

U.S. PATENT DOCUMENTS

| | | | |
|---|---|---|---|
| 3,676,702 | 7/1972 | McGrogan, Jr. | 307/235 |
| 4,429,305 | 1/1984 | Hosokawa et al. | 340/784 |
| 4,532,438 | 7/1985 | Reiner | 307/362 |
| 4,742,346 | 5/1988 | Gillette et al. | 340/793 |
| 4,766,430 | 8/1988 | Gillette et al. | 340/793 |
| 4,963,860 | 10/1990 | Stewart | 340/719 |
| 5,017,914 | 5/1991 | Uchida et al. | 340/784 |
| 5,113,134 | 5/1992 | Plus et al. | 324/158 |
| 5,170,155 | 12/1992 | Plus et al. | 340/784 |
| 5,222,082 | 6/1993 | Plus | 377/79 |

OTHER PUBLICATIONS (RCA 87825) U.S. Ser. No. 08/399,011, filed Mar. 6, 1995, by S. Weisbrod, entitled A Data Line Driver For Applying Brightness Signals to a Display.

(RCA 87577) U.S. Ser. No. 08/399,009, filed Mar. 6, 1995 by R.I.A. Huq, et al., entitled Data Line Drivers With Common Reference Ramp Display.

(RCA 87876) U.S. Ser. No. 08/398,822, filed Mar. 6, 1995 by A.G.F. Dingwall, et al., entitled An Amplifier With Pixel Voltage Compensation For a Display.

*Primary Examiner*—Richard Hjerpe
*Assistant Examiner*—David L. Lewis
*Attorney, Agent, or Firm*—Joseph S. Tripoli; Joseph J. Laks; Sammy S. Henig

[57] ABSTRACT

A video display driver applies a video signal to column electrodes of a liquid crystal display. The display driver includes a reference ramp generator and column data line drivers. A reference ramp signal is combined with the video signal and applied to an input of a comparator. The comparator controls a first transistor that couples a data ramp signal to a given column of pixels. The first transistor at least partially initializes a voltage developed in the given column of pixels prior to an instant when the data ramp signal begins upramping. A second transistor that is coupled in parallel with the first transistor insures that the column voltage is fully initialized.

6 Claims, 3 Drawing Sheets

PRE-DCTRL
DCTRL(1)
DCTRL(i)
DCTRL(24)
20V
0
9μs
11μs
t5a
23μs
23.9μs
20V/28V
PRE_AUTOZ
AUTOZERO & RESET
DXFER
5μs
t3
8μs
12V
REF_RAMP
500
20μs
t9
t4
8.8V/16.8V
DATA_RAMP
1V/9V
VIAD
17μs
10μs
t8
t10
t6
AZ
30V
C_BOOT
13μs
t7
9μs
t0
t1
t2
t5
t19
t20
4μs
32μs

DATA LINE DRIVERS WITH COLUMN INITIALIZATION TRANSISTOR

This invention relates generally to drive circuits for display devices and particularly to a system for applying brightness signals to pixels of a display device, such as a liquid crystal display (LCD).

Display devices, such as liquid crystal displays, are composed of a matrix or an array of pixels arranged horizontally in rows and vertically in columns. The video information to be displayed is applied as brightness (gray scale) signals to data lines which are individually associated with each column of pixels. The row of pixels are sequentially scanned and the capacitances of the pixels within the activated row are charged to the various brightness levels in accordance with the levels of the brightness signals applied to the individual columns.

In an active matrix display each pixel element includes a switching device which applies the video signal to the pixel. Typically, the switching device is a thin film transistor (TFT), which receives the brightness information from solid state circuitry. Because both the TFT's and the circuitry are composed of solid state devices it is preferable to simultaneously fabricate the TFT's and the drive circuitry utilizing either amorphous silicon or polysilicon technology.

Liquid crystal displays are composed of a liquid crystal material which is sandwiched between two substrates. At least one, and typically both of the substrates, is transparent to light and the surfaces of the substrates which are adjacent to the liquid crystal material support patterns of transparent conductive electrodes arranged in a pattern to form the individual pixel elements. It may be desirable to fabricate the drive circuitry on the substrates and around the perimeter of the display together with the TFT's.

Amorphous silicon has been the preferable technology for fabricating liquid crystal displays because this material can be fabricated at low temperatures. Low fabrication temperature is important because it permits the use of standard, readily available and inexpensive substrate materials. However, the use of amorphous silicon thin film transistors (a-Si TFTs) in integrated peripheral pixel drivers has been limited because of, low mobility, threshold voltage drift and the availability of only N-MOS enhancement transistors.

U.S. Pat. No. 5,170,155 in the names of Plus et al., entitled "System for Applying Brightness Signals To A Display Device And Comparator Therefore", describes a data line or column driver of an LCD. The data, line driver of Plus et al., operates as a chopped ramp amplifier and utilizes TFT's. In the data line driver of Plus et al., an analog video signal containing picture information and a reference ramp produced in a reference ramp generator are applied to a comparator. The comparator controls an output TFT that applies a data ramp voltage to a given data line. During the interval in which the data ramp voltage ramps, the comparator is triggered and the output TFT is turned off. Thus, the value of the data ramp voltage immediately prior to the triggering of the comparator remains stored in the pixel associated with the data line and forms the pixel signal in the current pixel updating cycle.

In order to prevent the pixel signal stored in the pixel capacitance in a preceding updating cycle from affecting the pixel signal stored in the current updating cycle, the stored pixel signal is discharged prior to the instant that the data ramp voltage begins ramping. The comparator is calibrated and, simultaneously, the output TFT is turned on prior to the ramping portion of the data ramp voltage and discharges the stored pixel signal to the level of the data ramp voltage corresponding to a black level. Because a relatively short time is available for initializing the pixel signal, the output TFT might have to be driven with a higher gate-to-source voltage than would have been required for merely applying the data ramp voltage to the data line. Consequently, the output TFT may be more stressed than desirable. This results in the conductivity of the output TFT being reduced and in the threshold voltage of the TFT being made susceptible to drift.

A seemingly simple solution, such as increasing the size of the TFT to increase its conductivity, is undesirable because of the accompanying increase in gate-source and gate-drain capacitances. It is desirable to initialize the stored pixel signal without using excessive drive and without increasing the size of the output TFT.

A data line driver, embodying an aspect of the invention, applies a video signal to a column electrode of a display device. A source of the video signal and a source of a data ramp signal are provided. A first transistor is responsive to the video signal for applying the data ramp Signal to the column electrode during a controllable portion of a period of the data ramp signal that varies in accordance with the video signal. A column electrode signal is developed at the column electrode. A second transistor is responsive to an initialization control signal and coupled to the column electrode for initializing the column electrode signal.

Figure 1:
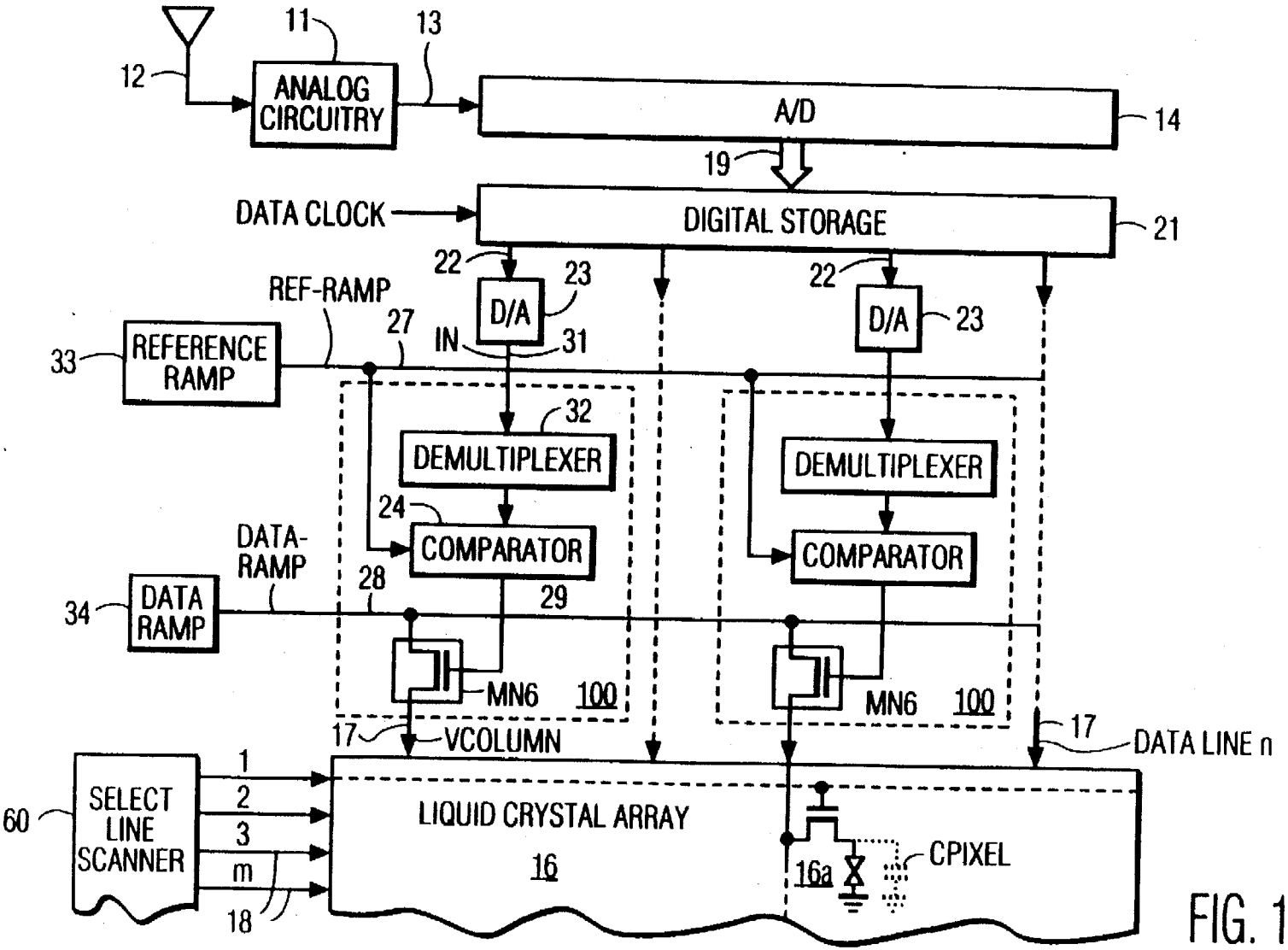
FIG. 1 illustrates a block diagram of a liquid crystal display arrangement that includes demultiplexer and data line drivers, embodying an aspect of the invention.

In FIG. 1, that includes a multiplexer and data line drivers 100, embodying an aspect of the invention, an analog circuitry 11 receives a video signal representative of picture information to be displayed from, for example, an antenna 12. The analog circuitry 11 provides a video signal on a line 13 as an input signal to an analog-to-digital converter (A/D) 14.

The television signal from the analog circuitry 11 is to be displayed on a liquid crystal array 16 which is composed of a large number of pixel elements, such as a liquid crystal cell 16*a*, arranged horizontally in m=560 rows and vertically in n=960 columns. Liquid crystal array 16 includes n=960 columns of data lines 17, one for each of the vertical columns of liquid crystal cells 16*a*, and m=560 select lines 18, one for each of the horizontal rows of liquid crystal cells 16*a*.

A/D converter 14 includes an output bus bar 19 to provide brightness levels, or gray scale codes, to a memory 21 having 40 groups of output lines 22. Each group of output lines 22 of memory 21 applies the stored digital information to a corresponding digital-to-analog (D/A) converter 23. There are 40 D/A converters 23 that correspond to the 40 groups of lines 22, respectively. An output signal IN of a given D/A converter 23 is coupled via a corresponding line 31 to corresponding multiplexer and data line driver 100 that drives corresponding data line 17. A select line scanner 60 produces row select signals in lines 18 for selecting, in a conventional manner, a given row of array 16. The voltages developed in 960 data lines 17 are applied during a 32 microsecond line time, to pixels 16*a* of the selected row.

A given demultiplexer and data line driver 100 uses chopped ramp amplifiers, not shown in detail in FIG. 1, with a low input capacitance that is, for example, smaller than 1 pf to store corresponding signal IN and to transfer stored input signal IN to corresponding data line 17. Each data line 17 is applied to 560 rows of pixel cells 16*a* that form a capacitance load of, for example, 20 pf.

Figure 2:
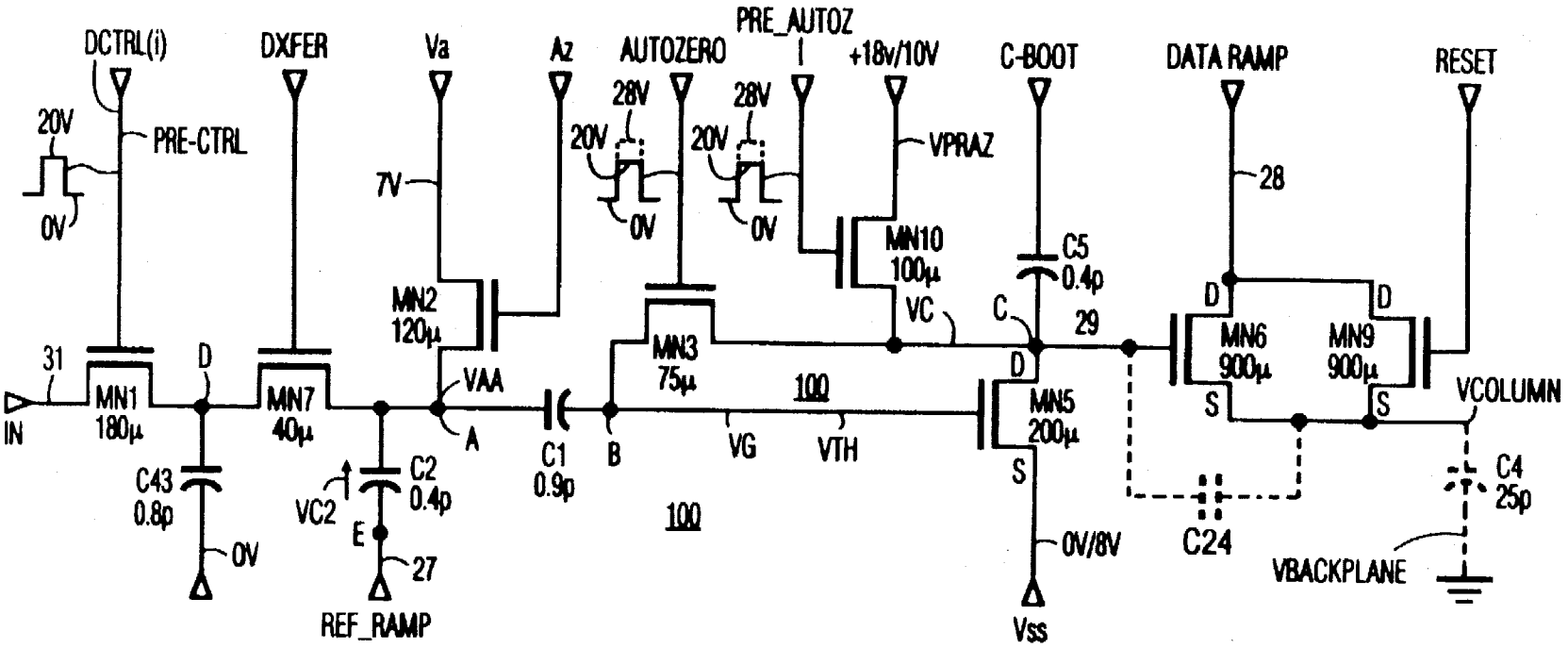
FIG. 2 illustrates the demultiplexer and data line driver of FIG. 1 in more detail.

FIG. 2 illustrates in detail a given one of demultiplexer and data line drivers 100. FIGS. 3*a*–3*h* illustrate waveforms useful for explaining the operation of the circuit of FIG. 2. Similar symbols and numerals in FIGS. 1, 2 and 3*a*–3*h* indicate similar items or functions. All the transistors of demultiplexer and line driver 100 of FIG. 2 are TFT's of the N-MOS type. Therefore, advantageously, they can be formed together with array 16 of FIG. 1 as one integrated circuit.

Figures 3A, 3B, 3C, 3D, 3E, 3F, 3G, 3H:
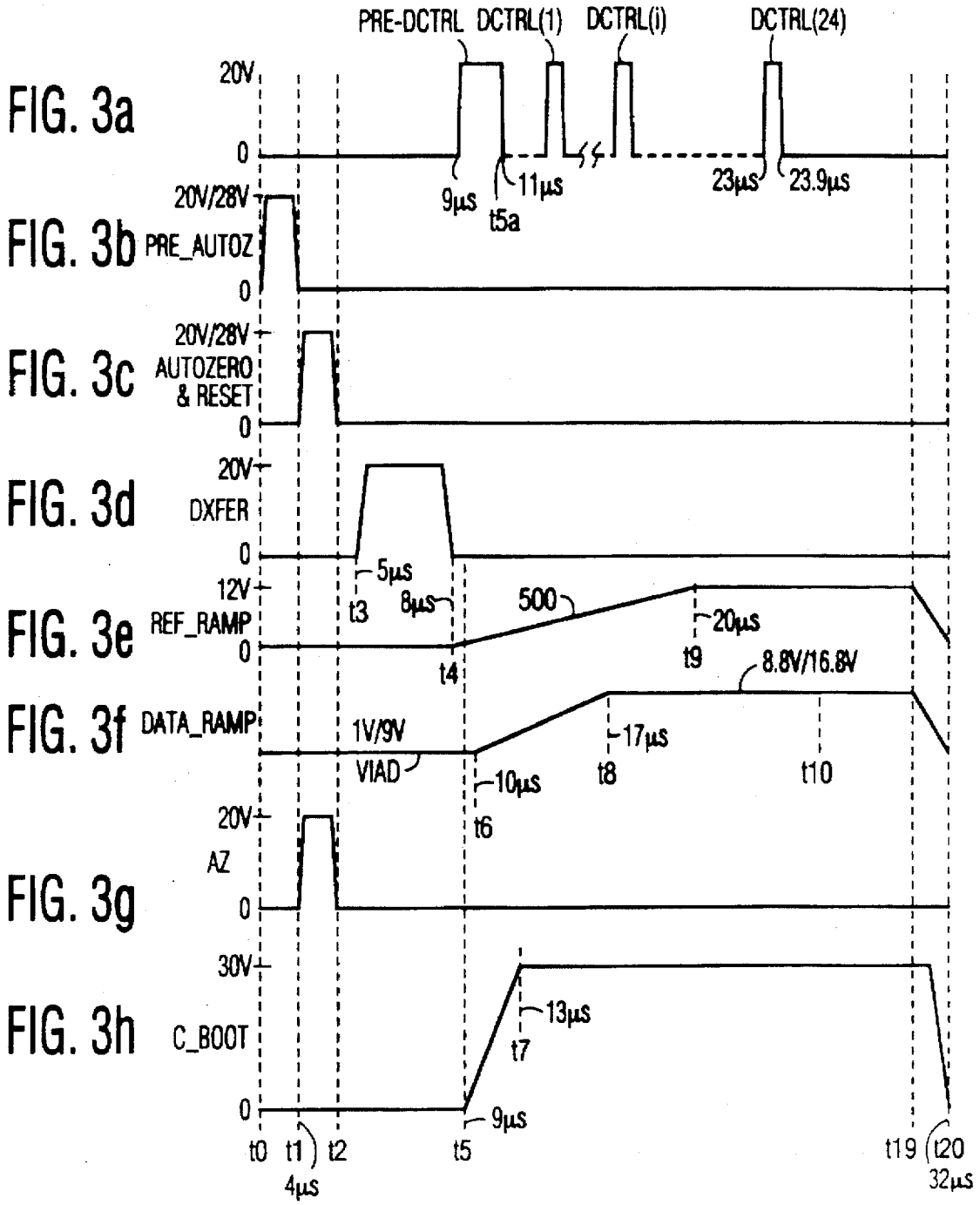
FIGS. 3*a*–3*h* illustrate waveforms useful for explaining the operation of the circuit of FIG. 2.

Prior to sampling the video signal in signal line 31 of FIG. 2, a voltage developed at a terminal D of a capacitor C43 is initialized. To initialize the voltage in capacitor C43, D/A converter 23 develops a predetermined voltage in line 31 such as the maximum, or full scale voltage of video signal IN. A transistor MN1 applies the initializing voltage in line 31 to capacitor C43 when a control pulse PRE-DCTRL of FIG. 3*a* is developed at the gate of transistor MN1. In this way, the voltage in capacitor C43 is the same prior to each pixel updating cycle. Following pulse PRE-DCTRL, signal IN changes to contain video information that is used for the current pixel updating cycle.

Demultiplexer transistor MN1 of a demultiplexer 32 of FIG. 2 samples analog signal IN developed in signal line 31 that contains video information. The sampled signal is stored in sampling capacitor C43 of demultiplexer 32. The sampling of a group of 40 signals IN of FIG. 1 developed in lines 31 occurs simultaneously under the control of a corresponding pulse signal DCTRL(i). As shown in FIG. 3*a*, 24 pulse signals DCTRL(i) occur successively, during an interval following t5a-t20. Each pulse signal DCTRL(i) of FIG. 2 controls the demultiplexing operation in a corresponding group of 40 demultiplexers 32. The entire demultiplexing operation of 960 pixels occurs in interval t5a-t20 of FIG. 3*a*.

To provide an efficient time utilization, a two-stage pipeline cycle is used. Signals IN are demultiplexed and stored in 960 capacitors C43 of FIG. 2 during interval t5a-t20, as explained before. During an interval t3-t4 of FIG. 3*d*, prior to the occurrence of any of pulse PRE-DCTRL and the 24 pulse signals DCTRL of FIG. 3*a*, each capacitors C43 of FIG. 2 is coupled to a capacitor C2 via a transistor MN7 when a pulse signal DXFER of FIG. 3*d* occurs. Thus, a portion of signal IN that is stored in capacitor C43 is transferred to capacitor C2 of FIG. 2 and develops a voltage VC2. During interval t5a-t20, when pulse signals DCTRL of FIG. 3*a* occur, voltage VC2 of FIG. 2 in capacitor C2 is applied to array 16 via corresponding data line 17, as explained below. Thus, signals IN are applied to array 16 via the two-stage pipeline.

A reference ramp generator 33 provides a reference ramp signal REF-RAMP on an output conductor 27. Conductor 27 is coupled, for example, in common to a terminal E of each capacitor C2 of FIG. 2 of each demultiplexer and data line driver 100. A terminal A of capacitor C2 forms an input terminal of a comparator 24. A data ramp generator 34 of FIG. 1 provides a data ramp voltage DATA-RAMP via an output line 28. In demultiplexer and data line driver 100 of FIG. 2, a transistor MN6 applies voltage DATA-RAMP to data line 17 to develop a voltage VCOLUMN. The row to which voltage VCOLUMN is applied is determined in accordance with row select signals developed in row select lines 18. A display device using a shift register for generating select signals such as developed in lines 18 is described in, for example, U.S. Pat. Nos. 4,766,430 and 4,742,346.

Transistor MN6 is a TFT having a gate electrode that is coupled to an output terminal C of comparator 24 by a conductor 29. An output voltage VC from the comparator 24 controls the conduction interval of transistor MN6.

In each pixel updating period, prior to applying voltage VC of comparator 24 to transistor MN6 to control the conduction interval of transistor MN6, comparator 24 is automatically calibrated or adjusted. At time t0 (FIG. 3*b*) transistor MN10 is conditioned to conduct by a signal PRE-AUTOZ causing imposition of a voltage VPRAZ onto the drain electrode of a transistor MN5 and the gate electrode of transistor MN6. This voltage, designated VC, stored on stray capacitances such as, for example, a source-gate capacitance C24, shown in broken lines, of transistor MN6 causes transistor MN6 to conduct. Transistor MN5 is nonconductive when transistor MN10 pre-charges capacitance C24.

At a time t1 of FIG. 3*b*, pulse signal PRE-AUTOZ terminates and transistor MN10 is turned off. At time t1, a pulse signal AUTOZERO is applied to a gate electrode of a transistor MN3 that is coupled between the gate and drain terminals of transistor MN5 to turn on transistor MN3. Simultaneously, a pulse signal AZ of FIG. 3*g* is applied to a gate electrode of a transistor MN2 to turn on transistor MN2. When transistor MN2 is turned on, a voltage Va is coupled through transistor MN2 to terminal A of a coupling capacitor C1. Transistor MN2 develops a voltage VAA at terminal A at a level of voltage Va for establishing a triggering level of comparator 24 at terminal A. The triggering level of comparator 24 is equal to voltage Va. A second terminal B of capacitor C1 is coupled to transistor MN3 and the gate of transistor MN5.

Conductive transistor MN3 equilabrates the charge at terminal C, between the gate and drain electrodes of transistor MN5, and develops a gate voltage VG on the gate electrode of transistor MN5 at terminal B. Initially, voltage VG exceeds a threshold level VTH of transistor MN5 and causes transistor MN5 to conduct. The conduction of transistor MN5 causes the voltages at each of terminals B and C to decrease until each becomes equal to the threshold level VTH of transistor MN5, during the pulse of signal AUTOZERO. Gate electrode voltage VG of transistor MN5 at terminal B is at its threshold level VTH when voltage VAA at terminal A is equal to voltage Va. At time t2 of FIGS. 3*c* and 3*f*, transistors MN3 and MN2 of FIG. 2 are turned off and comparator 24 is calibrated or adjusted. Therefore, the triggering level of comparator 24 of FIG. 2 with respect to input terminal A is equal to voltage Va.

As explained above, pulse signal DXFER developed, beginning at time t3, at the gate of transistor MN7 couples capacitor C43 of demultiplexer 32 to capacitor C2 via terminal A. Consequently, voltage VC2 that is developed in capacitor C2 is proportional to the level of sampled signal IN in capacitor C43. The magnitude of signal IN is such that voltage VAA developed at terminal A, during pulse signal DXFER, is smaller than triggering level Va of comparator 24. Therefore, comparator transistor MN5 remains nonconductive immediately after time t3. A voltage difference between voltage VAA and the triggering level of comparator 24 that is equal to voltage Va is determined by the magnitude of signal IN.

When voltage VAA at terminal A exceeds voltage Va, transistor MN5 becomes conductive. On the other hand, when voltage VAA at terminal A does not exceed voltage Va, transistor MN5 is nonconductive. The automatic calibration or adjustment of comparator 24 compensates for threshold voltage drift, for example, in transistor MN5.

In carrying out an aspect of the invention, a reset transistor MN9 is coupled in parallel with transistor MN6, to turn on transistor MN9 between the column electrode and the data ramp electrode 20. A pulse RESET is applied to the gate electrode of transistor MN9. The pulse, RESET, has a waveform and timing similar to that of pulse signal AUTOZERO of FIG. 3c. When transistor MN9 of FIG. 2 is conductive, it applies the current potential available on conductor 28 to the column bus 17. Transistor MN9 is conditioned to conduct prior to ramping of the data ramp and thereby to discharge any residual potential on line 17. Advantageously, this prevents previous stored picture information contained in the capacitance of pixel cell 16a from affecting pixel voltage VCOLUMN at the current update period of FIGS. 3b–3g.

Transistor MN9 establishes voltage VCOLUMN at an inactive level VIAD of signal DATA-RAMP, prior to time t6. A capacitance C4 associated with the data line 17 has been partially charged/discharged toward inactive level VIAD of signal DATA-RAMP, during interval t0-t1, immediately after transistor MN10 has been turned on. During pulse signal AUTOZERO, gate voltage VC of transistor MN6 is reduced to the threshold voltage of transistor MN5. Therefore, transistor MN6 is substantially turned off. The charge/discharge of capacitance C4 is performed predominantly during interval t1-t2, when transistor MN9 is turned on. Advantageously, utilizing both transistor MN9 and transistor MN6, for establishing the initial conditions of voltage VCOLUMN, reduces a threshold voltage drift of transistor MN6. The threshold voltage drift of transistor MN6 is reduced because transistor MN6 is driven with a lower gate-source voltage than if transistor MN9 were absent.

Advantageously, transistor MN9 provides an additional current path between data line 17 and line 28 for pixel voltage initialization purposes. The additional current path provided by separate transistor MN9 permits the usage of a transistor MN6 that is smaller. Therefore, an undesired increase in the parasitic gate-source and gate drain capacitances of transistor MN6, that might have resulted had a larger size transistor MN6 been used, is avoided.

Transistor MN6 is designed to have similar parameters and stress and, therefore, a similar threshold voltage drift as transistor MN5. Therefore, advantageously, the threshold voltage drift of transistor MN6 tracks the threshold voltage drift of transistor MN5.

In one of two modes of operations that are discussed below, source voltage Vss of transistor MN5 is equal to 0V. Also voltage VCOLUMN, during interval t2-t4, that is equal to inactive level VIAD of signal DATA-RAMP, is equal to 1V. Drain voltage VC of transistor MN5 at terminal C, prior to time t5, is equal to threshold voltage VTH of transistor MN5. Because of the aforementioned tracking, variation of threshold voltage VTH of transistor MN5 maintains the gate-source voltage of transistor MN6 at a level that is 1V less than the threshold voltage of transistor MN6. The 1V difference occurs because there is a potential difference of one volt between the source electrodes of transistors MN5 and MN6.

Advantageously, a pulse voltage C-BOOT of FIG. 3h is capacitively coupled via a capacitor C5 of FIG. 2 to terminal C, at the gate of transistor MN6. Capacitor C5 and capacitance C24 form a voltage divider. The magnitude of voltage C-BOOT is selected so that gate voltage VC increases with respect to the level developed, during pulse AUTOZERO, by a predetermined small amount sufficient to maintain transistor MN6 conductive. As explained before, transistor MN5 is nonconductive following time t3 of FIG. 3d. Thus, the predetermined increase in voltage VC that is in the order of 5V is determined by the capacitance voltage divider that is formed with respect to voltage BOOT-C at terminal C. The increase in voltage VC is independent on threshold voltage VTH. Therefore, threshold voltage drift of transistor MN5 or MN6 over the operational life, does not affect the increase by voltage C-BOOT. It follows that, over the operational life when voltage VTH may significantly increase, transistor MN6 is maintained conductive with small drive prior to time t6 of FIG. 3f.

Any threshold voltage drift of voltage VTH of transistor MN5 will cause the same change in voltage VC at terminal C. Assume that the threshold voltage of transistor MN6 tracks that of transistor MN5. Therefore, voltage C-BOOT need not compensate for threshold voltage drift of transistor MN6. It follows that transistor MN6 will be turned on by voltage C-BOOT irrespective of any threshold voltage drift of transistor MN5 and MN6. Thus, the threshold voltage variation of transistor MN5 compensates that of transistor MN6.

The capacitance coupling of voltage C-BOOT enables using gate voltage VC of transistor MN6 at terminal C at a level that is only slightly greater than the threshold voltage of transistor MN6 such as by 5V over the threshold voltage of transistor MN6. Therefore, transistor MN6 is not significantly stressed. By avoiding significant drive voltages to the gate electrode of transistor MN6, advantageously, threshold voltage drift in transistor MN6 that may occur over its operational life is substantially smaller than if transistor MN6 were driven with a large drive voltage.

Advantageously, voltage C-BOOT is developed in a ramping manner during interval t5-t7 of FIG. 3h. The relatively slow rise time of voltage C-BOOT helps reduce the stress on transistor MN6. Having the gate voltage of transistor MN6 increase slowly allows the source of transistor MN6 to charge such that the gate-source potential difference remains smaller for larger periods. Interval t5-t7 has a length of 4 μsec. By maintaining the length of interval t5-t7 longer than 2 μsec, or approximately 20% of the length of interval t6-t8 of signal DATA-RAMP of FIG. 2f, the voltage difference between the gate and the source voltage in transistor MN6 is, advantageously, reduced for a significantly large period. Therefore, stress is reduced in TFT MN6.

At time t4 of FIG. 3e, reference ramp signal REF-RAMP begins up-ramping. Signal REF-RAMP is coupled to terminal E of capacitor C2 of FIG. 2 that is remote from input terminal A of comparator 24. As a result, voltage VAA at input terminal A of comparator 24 is equal to a sum voltage of ramping signal REF-RAMP and voltage VC2 developed in capacitor C2.

Advantageously, during interval t1-t2 of FIG. 3c, when the automatic triggering voltage adjustment or calibration of comparator 24 occurs, transistor MN2 couples voltage Va to capacitor C2 via terminal A, that is remote from reference ramp generator 33. Similarly, during interval t3-t4, when the charge is transferred to capacitor C2, transistor MN7 is coupled to capacitor C2 via terminal A that is remote from ramp generator 33. Thus, terminal E of capacitor C2, advantageously, need not be decoupled from conductor 27 of reference ramp generator 33. Because terminal E need not be decoupled from reference ramp generator 33, signal REF-RAMP is coupled to terminal A of comparator 24 without interposing any TFT switch between conductor 27 of reference ramp generator 33 and terminal A. A TFT in the signal path might have suffered from threshold voltage drift. Advantageously, conductor 27 may be common to several units of multiplexer and data drivers 100.

Following time t6, data ramp voltage DATA-RAMP coupled to the drain electrode of transistor MN6 begins upramping. With feedback coupling to terminal C from the stray gate-source and gate driven capacitance of transistor MN6, the voltage at terminal C will be sufficient to condition transistor MN6 to conduct for all values of the data ramp signal DATA-RAMP. Following time t4, and as long as ramping voltage VAA at terminal A has not reached the triggering level that is equal to voltage Va of comparator 24, transistor MN5 remains non-conductive and transistor MN6 remains conductive. As long as transistor MN6 is conductive, upramping voltage DATA-RAMP is coupled through transistor MN6 to column data line 17 for increasing the potential VCOLUMN of data line 17 and, therefore, the potential applied to pixel capacitance CPIXEL of the selected row. The capacitive feedback of ramp voltage VCOLUMN via, for example, capacitance 24, sustains transistor MN6 in conduction, as long as transistor MN5 exhibits a high impedance at terminal C, as indicated before.

At some time during the upramping portion 500 of signal REF-RAMP of FIG. 3*e*, the sum voltage VAA at terminal A will exceed the triggering level Va of comparator 24, and transistor MN5 will become conductive. The instant that transistor MN5 becomes conductive is determined by the magnitude of signal IN.

When transistor MN5 becomes conductive, gate voltage VC of transistor MN6 decreases and causes transistor MN6 to turn off. As a result, the last value of voltage DATA-RAMP that occurs prior to the turn-off of transistor MN6 is held unchanged or stored in pixel capacitance CPIXEL until the next updating cycle. In this way, the current updating cycle is completed.

In order to prevent polarization of liquid crystal array 16 of FIG. 1, a so-called backplane or common plane of the array, not shown, is maintained at a constant voltage VBACKPLANE. Multiplexer and data line driver 100 produces, in one updating cycle, voltage VCOLUMN that is at one polarity with respect to voltage VBACKPLANE and at the opposite polarity and the same magnitude, in an alternate updating cycle. To attain the alternate polarities, voltage DATA-RAMP is generated in the range of 1V–8.8V in one updating cycle and in the range of 9V–16.8V in the alternate update cycle. Whereas, voltage VBACKPLANE is established at an intermediate level between the two ranges. Because of the need to generate voltage DATA-RAMP in two different voltage ranges, signals or voltages AUTOZERO, PRE-AUTOZ, Vss and RESET have two different peak levels that change in alternate updating cycles in accordance with the established range of voltage DATA-RAMP.

What is claimed is:

1. A data line driver for applying a video signal to a column electrode of a display device, comprising:

a source of said video signal;

a source of a data ramp signal;

a first transistor having a first main current conducting terminal coupled to said source of said data ramp signal and a second main current conducting terminal coupled to said column electrode and responsive to said video signal for applying said data ramp signal to said column electrode during a controllable portion of a period of said data ramp signal that varies in accordance with said video signal to develop a column electrode signal at said column electrode; and a second transistor responsive to an initialization control signal and coupled to said column electrode for initializing said column electrode signal via a signal path that bypasses said first transistor.

2. A data line driver according to claim 1 wherein a main current conducting current path in said first transistor is coupled in parallel with a main current conducting path of said second transistor.

3. A data line driver according to claim 1 wherein said first transistor at least partially initializes said column electrode signal prior to said controllable portion.

4. A data line driver according to claim 1 wherein, prior to said controllable portion, each of said first and second transistors couples said column electrode to said data ramp signal source for applying an inactive level of said data ramp signal to said column electrode.

5. A data line driver according to claim 4 wherein said first and second transistors apply said inactive level to said column electrode during first and second intervals, respectively, that are at least partially non-overlapping.

6. A data line driver according to claim 1 further comprising, a comparator coupled to a control terminal of said first transistor for controlling said controllable portion, a source of a second control signal coupled to said comparator for calibrating said comparator, said second control signal rendering said first transistor conductive in a manner to provide for at least partial initialization of said column electrode signal.

* * * * *